US006076499A

United States Patent [19]

Klumpp

[11] Patent Number: 6,076,499

[45] Date of Patent: Jun. 20, 2000

[54] INTAKE SYSTEM OF A MULTI-CYLINDER INTERNAL COMBUSTION ENGINE WITH EXHAUST GAS RECIRCULATION

[75] Inventor: Peter Klumpp, Stuttgart, Germany

[73] Assignee: DaimlerChrysler AG, Stuttgart, Germany

[21] Appl. No.: 09/270,959

[22] Filed: Mar. 16, 1999

[30] Foreign Application Priority Data

Mar. 19, 1998 [DE] Germany ..... 198 12 089

[51] Int. Cl.[7] ..... F02D 9/08

[52] U.S. Cl. ..... 123/337; 123/590; 123/306; 251/305

[58] Field of Search ..... 123/337, 306, 123/590, 593; 251/305

[56] References Cited

U.S. PATENT DOCUMENTS 4,438,745 3/1984 Watanabe ..... 123/337
4,672,940 6/1987 Nakayama et al. ..... 123/590
4,969,354 11/1990 Kosuda et al. ..... 73/118.2
5,924,398 7/1999 Choi ..... 123/590

FOREIGN PATENT DOCUMENTS 34 25 378 1/1985 Germany .

*Primary Examiner*—Henry C. Yuen
*Assistant Examiner*—Hien T. Vo
*Attorney, Agent, or Firm*—Klaus J. Bach

[57] ABSTRACT

In an air intake system of a multi-cylinder internal combustion engine with exhaust gas recirculation, particularly a Diesel engine, including an intake duct with a throttle valve wherein the intake duct is connected to an intake manifold of the engine and an exhaust gas recirculation conduit is connected to the intake duct downstream of the throttle valve, the throttle valve includes a valve member provided with a turbulence plate which has a diameter smaller than the valve member and extends normal to the valve member, and the valve member has passages and the turbulence member has holes for generating turbulence in the intake duct downstream of the throttle valve.

5 Claims, 2 Drawing Sheets

INTAKE SYSTEM OF A MULTI-CYLINDER INTERNAL COMBUSTION ENGINE WITH EXHAUST GAS RECIRCULATION

BACKGROUND OF THE INVENTION

The invention resides in an intake system of a multicylinder internal combustion engine with exhaust gas recirculation, particularly a Diesel engine, including an intake duct with a throttle valve. The intake duct is connected to an intake manifold with intake duct structures leading to the various cylinders. An exhaust gas recirculation line is connected to the intake duct downstream of the throttle valve.

It is well known that, with exhaust gas recirculation (EGR), $NO_x$ emissions can be substantially reduced in gasoline as well as in Diesel engines especially in the partial power operating range of the engines. Generally, with external EGR systems, exhaust gas is introduced into the intake duct by way of an EGR valve downstream of the throttle valve (see, for example, DE 34 25 378 A1). It has been found however that a uniform mixture of exhaust gas and intake air (air or air/fuel mixture) cannot be achieved in this way so that no uniform exhaust gas/air mixture is supplied to the various cylinders of the engine.

It is the object of the present invention to provide an intake system for a multi-cylinder internal combustion engine with exhaust gas recirculation wherein the exhaust gas is uniformly mixed with the charge air over the full engine operating range that is in every position of the throttle valve.

SUMMARY OF THE INVENTION

In an air intake system of a multi-cylinder internal combustion engine with exhaust gas recirculation, particularly a Diesel engine, including an intake duct with a throttle valve wherein the intake duct is connected to an intake manifold of the engine and an exhaust gas recirculation conduit is connected to the intake duct downstream of the throttle valve, the throttle valve includes a valve member provided with a turbulence plate which has a diameter smaller than the valve member and extends normal to the valve member, and the valve member has passages and the turbulence member has holes for generating turbulence in the intake duct downstream of the throttle valve.

The passages in the throttle valve member particularly in a closed or slightly open position of the valve generate a turbulence, whereby the exhaust gas in the intake duct upstream of the intake manifold is thoroughly mixed with the charge air. The more the valve is opened, the lower is the effect of the passages in the control member since, then, the valve member is no longer disposed in a plane normal, or close to normal, to the direction of the gas flow in the intake duct. In that operating range, that is, when the valve control member is halfway to fully open holes arranged in the turbulence plate which extends normal to valve control member become active so as to generate a turbulence, which corresponds to the turbulence generated by the valve control member in the same angular position.

As a result, a homogenous mixing of the exhaust gas with the charge air is obtained for any position of the throttle member and the recirculated exhaust gas content is the same in all the intake duct sections of the various cylinders. The passages in the valve control member and the holes in the turbulence plate always generate a turbulence which provides for a sufficiently uniform homogenous mixing of the exhaust gas and the intake air before they reach the intake manifold.

With the number, the type and the size of the passages in the valve member and the holes in the turbulence plate the extent of turbulence and the turbulence pattern can be influenced. Preferably, the arrangement of the passages and the location of the connection of the EGR conduit to the intake duct are so selected that the turbulence is greatest in the area of the connection.

It has been found to be particularly effective to arrange the connection of the EGR conduit to the intake duct at a distance from the throttle valve, which corresponds about to the diameter of the valve control member.

In an intake system, wherein the valve control member leaves an annular gap at its circumference when it is fully closed, the size of the passages in the control member is so selected that, in a closed position of the control member, the passages together with the annular gap provide for a charge air flow sufficient for idle operation of the engine.

The invention will be described below in greater detail on the basis of the accompanying drawings.

DESCRIPTION OF A PREFERRED EMBODIMENT

Figure 1:
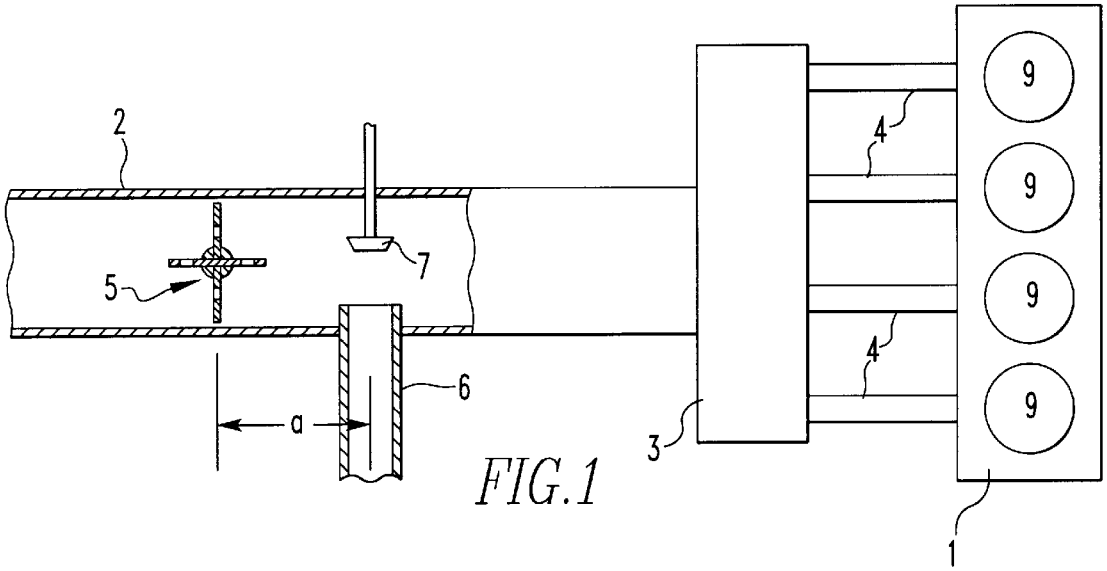
FIG. 1 shows schematically an intake system of a multi-cylinder internal combustion engine with external exhaust gas recirculation.
Figure 2:
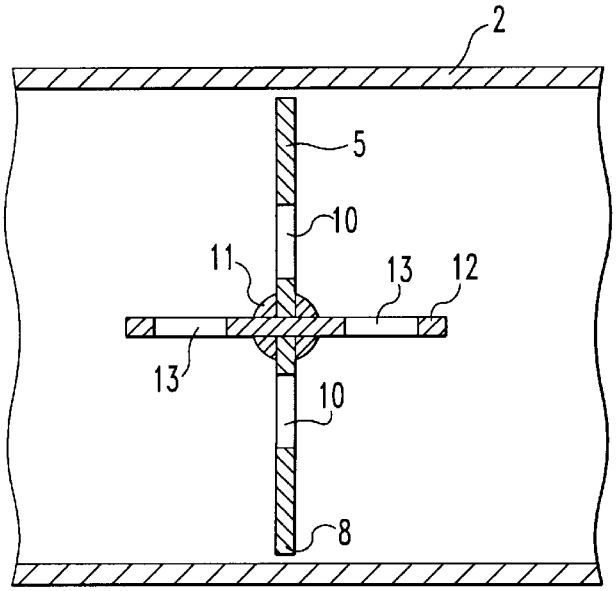
FIG. 2 is a cross-sectional view showing the section of the intake duct, which includes the valve control member.
Figure 3:
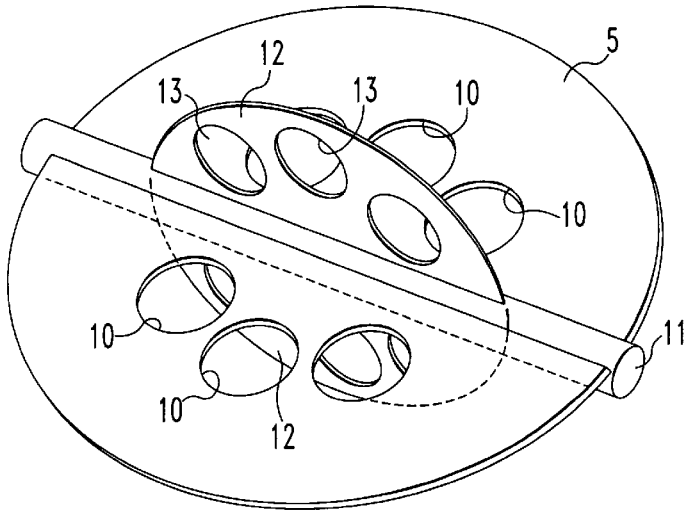
FIG. 3 is a perspective view of the valve control member.

FIG. 1 shows an intake system for a multi-cylinder internal combustion engine 1, which includes an intake duct 2, which, at its upstream end (left end in FIG. 1), is connected for example to a charge air cooler or to a carburetor. At its downstream end, the intake duct is connected to an intake manifold 3 from which intake duct sections 4 extend to the various cylinders 9. The intake duct 2 includes a throttle valve with a control member 5, which is a valve flap that has a diameter smaller than the intake duct 2. Consequently, an annular gap 8 remains between the control member 5 and the wall of the intake duct 2 permitting an intake air flow sufficient for idle operation of the engine. Downstream of the control member 5 an exhaust gas recirculation conduit 6 is connected to the intake duct, the exhaust gas recirculation (EGR) conduit opening being controlled by an EGR valve 7.

The throttle valve control member 5 is a valve flap, which include passages 10 adapted to provide in the intake duct 2, particularly in its closed or partially open positions, a turbulence by which an essentially uniform mixing of the recirculated exhaust gas with the charge air is achieved. As a result of such mixing, a homogeneous mixture of exhaust gas and charge air reaches the intake manifold 3 and, by way of the intake duct sections 4, the cylinders 9 of the internal combustion engine.

The effectiveness of the passages 10 is less the further the throttle valve control member 5 is opened; at its fully open position, the effectiveness is zero since then, the control member extends parallel to the flow in the intake duct 2. In order to obtain a high turbulence and an intensive mixture of the recirculated exhaust gas with the charge air over the whole operating range, that is also when the throttle valve is partially or fully open, a circular turbulence plate 12 of smaller diameter is mounted on the shaft 11 of the valve member 5 so as to extend normal to the valve member 5. The turbulence plate 12 penetrates the valve member 5 and is provided with holes 13, which correspond in number, in size and in their arrangement to the passages 10 formed in the valve member 5. When the valve member 5 is fully open the turbulence plate 12 extends normal to the flow direction in the intake duct. As a result, in this position, essentially the same turbulence is generated by the holes 13 of the turbulence plate as is by the passages 10 of the valve member 5 when the throttle valve is closed. In the intermediate positions of the valve member, both the passages 10 and the holes 13 are effective. As a result, a strong turbulence is generated in the intake duct downstream of the valve member 5 over the whole operating range of the engine.

The amount of turbulence and the turbulence pattern are dependent on the number, the size and the arrangement of the passages 10 and the holes 13.

The number, the size and the arrangement of the passages 10 and the holes 13 are determined by tests in such a way that the turbulence has a maximum in the area of the intake duct, where the exhaust gas recirculation conduit 6 is connected to the intake duct. This location was found to be at a distance from the valve member 5, which corresponds about o the diameter of the valve member 5.

Figure 4:
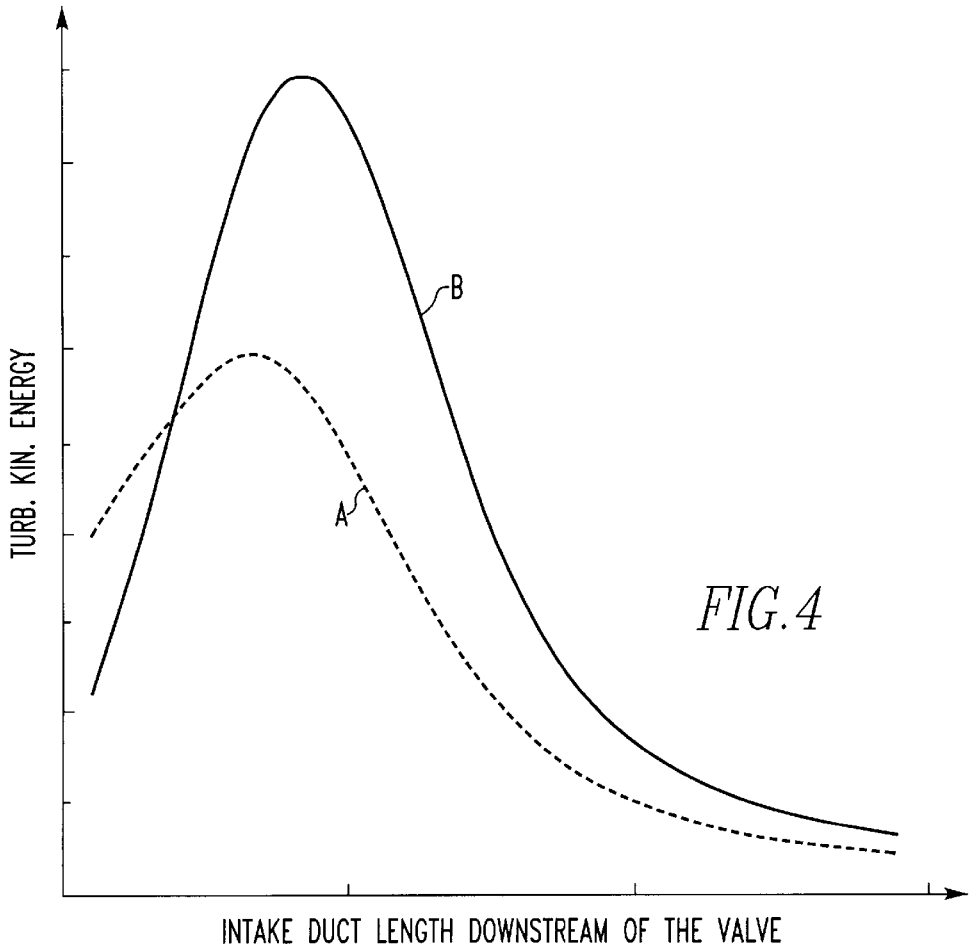
FIG. 4 is a diagram showing the turbulence intensity in the intake duct depending on the distance from the throttle valve.

The amount of turbulence and the turbulence distribution in the intake duct 2 downstream of valve member 5 are apparent from the diagram of FIG. 4. The curve A shows the turbulence distribution which is generated with a closed valve member that is by a valve member without passages where the air flows only through the annular gap 8. The curve B shows the turbulence generated with closed valve member 5 having the passages 10 and also the turbulence member 12 having the holes 13. The curve is essentially the same for a closed position of the valve member 5 when the air flows through the annular gap 8 and the passages 10, as it is for a partially open valve member 5 when the flow passes through the annular gap 8 and both the passages 10 and the holes 13, and for the fully open valve member 5 when the air flows only through the holes 13.

The passages 10 are so dimensioned that, together with the annular gap 8, they permit the passage of a sufficiently large charge air flow for maintaining idle operation of the engine. If the intake duct and the valve member 5 or so sized that no annular gap remains when the valve member 5 is closed then the passages 10 must be large enough to permit passage of a charge air flow sufficient to maintain idle engine operation.

What is claimed is:

1. A air intake system of a multi-cylinder internal combustion engine with exhaust gas recirculation, particularly a Diesel engine, including an intake duct with a throttle valve, said intake duct being connected to an intake manifold having intake duct sections leading to the various cylinders of said multicylinder internal combustion engine, an exhaust gas recirculation conduit connected to said intake duct downstream of said throttle valve for supplying exhaust gas to said intake duct, said throttle valve including a valve member pivotally supported in said intake duct and a turbulence plate of a diameter smaller than that of said valve member disposed on said valve member so as to extend normally to said valve member and essentially through its pivot axis, said valve member having passages and said turbulence plate having holes for generating turbulence in said intake duct downstream of said throttle valve.

2. An air intake system according to claim 1, wherein the holes in said turbulence plate correspond in numbers, size and arrangement to the passages in said valve member.

3. An air intake system according to claim 1, wherein said valve member is pivotally supported on a shaft and said turbulence plate penetrates said shaft.

4. An air intake system according to claim 1, wherein said exhaust gas recirculation conduit is connected to said intake duct at such a distance from said throttle valve and the size member and arrangement of said passages in said valve member and of the holes in said turbulence plate are so selected that the turbulence generated thereby in said intake duct reaches a maxim in the area where said exhaust gas recirculation conduit is connected to said intake duct.

5. An air intake system according to claim 4, wherein said exhaust gas recirculation conduit is connected to said intake duct at a distance from said throttle valve which corresponds about to the diameter of said valve member.

* * * * *